United States Patent [19]

Corona et al.

[11] Patent Number: 4,716,796

[45] **Date of Patent: * Jan. 5, 1988**

[54] MULTIBIT HAND TOOL WITH IMPROVED CHUCK ARRANGEMENT

[76] Inventors: Antonio Corona; Franco O. Corona, both of 175 Cumberland Street, Suite 1805, Toronto, Ontario, Canada, M5R 3M9

[ * ] Notice: The portion of the term of this patent subsequent to Nov. 12, 2002 has been disclaimed.

[21] Appl. No.: 845,931

[22] Filed: Mar. 28, 1986

Related U.S. Application Data

[63] Continuation-in-part of Ser. No. 796,633, Nov. 8, 1985, abandoned, which is a continuation of Ser. No. 681,886, Dec. 14, 1984, Pat. No. 4,552,043.

[51] Int. Cl.[4] ..... B25G 1/08

[52] U.S. Cl. ..... 81/177.4; 81/490

[58] Field of Search ..... 81/177.4, 437, 438, 81/439, 490; 7/167, 165, 170

[56] References Cited

U.S. PATENT DOCUMENTS

| | | | |
|---|---|---|---|
| 3,405,749 | 10/1968 | Butler | 81/177.4 |
| 4,372,361 | 2/1983 | Whiteford | 81/177.4 |
| 4,463,788 | 7/1984 | Corona et al. | 81/177.4 |
| 4,552,043 | 11/1985 | Corona et al. | 81/490 |

FOREIGN PATENT DOCUMENTS

| | | | |
|---|---|---|---|
| 951860 | 11/1956 | Fed. Rep. of Germany . | |
| 2906322 | 8/1979 | Fed. Rep. of Germany | 81/177.4 |
| 2408434 | 6/1977 | France . | |

*Primary Examiner*—Frederick R. Schmidt
*Assistant Examiner*—Maurina Rachuba
*Attorney, Agent, or Firm*—Willian Brinks Olds Hofer Gilson & Lione Ltd.

[57] ABSTRACT

A multibit hand tool has a plurality of bits provided in a circular pattern within a handle magazine. A rotatable selector cup at the end of the handle permits selection of a desired bit from the magazine and placement in a chuck in the handle. An elongate slot is provided in the cup to permit the manipulation of the bit. The improvement in this hand tool arrangement comprises an adaptation to the chuck and bit ends so that the selected bit end is readily placed within the chuck. This feature is accomplished by providing a number of operative faces on the bit end equal to the number of bits provided in the handle. Similarly, the chuck has a bore presenting a corresponding plurality of internal operative faces for engaging the bit end.

10 Claims, 16 Drawing Figures

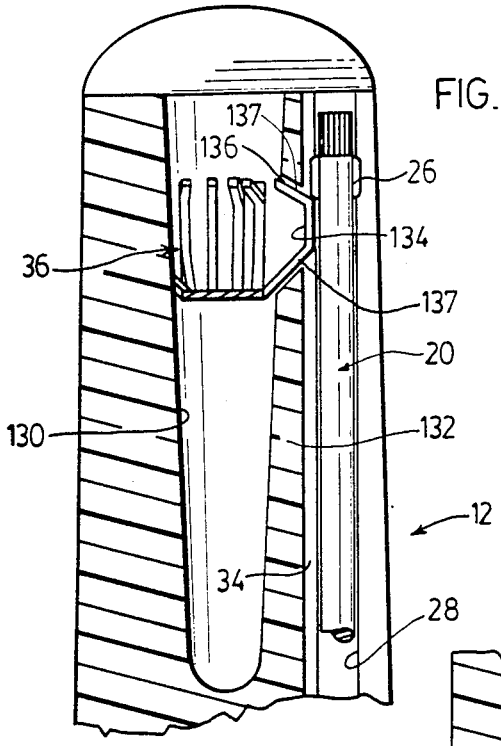
FIG. 9.
FIG. 10.
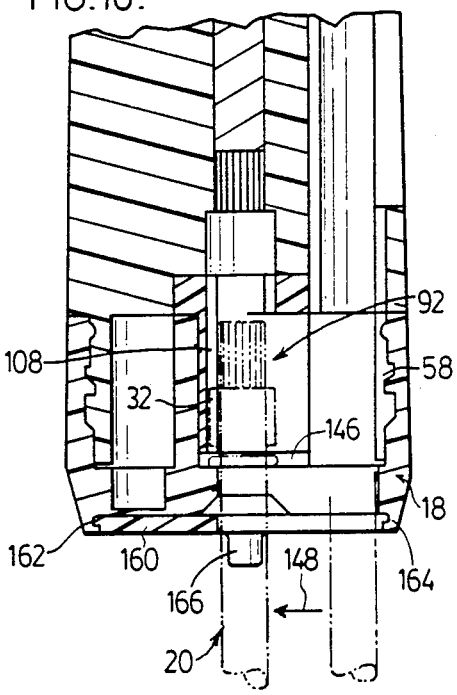
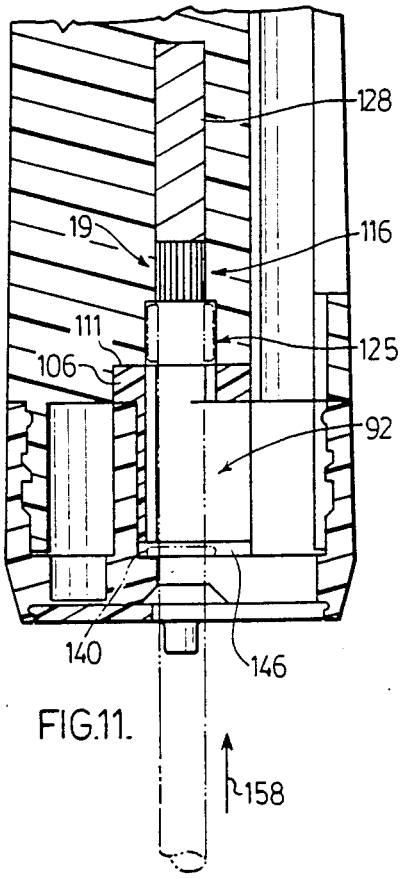
FIG. 11.

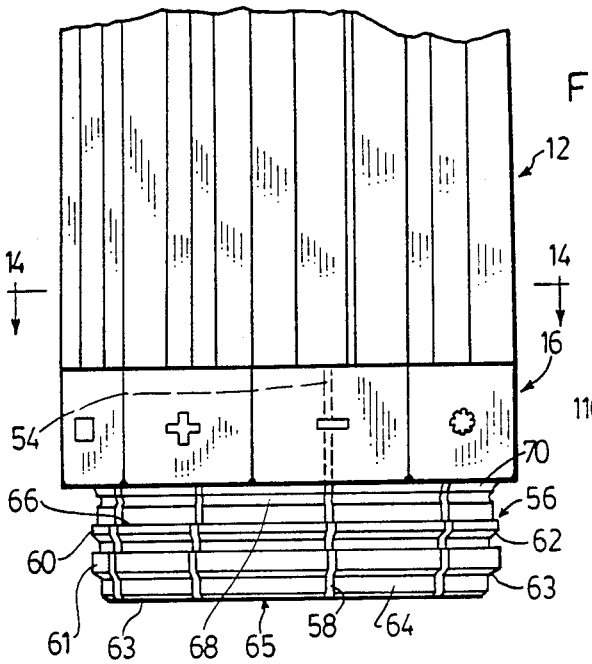
FIG.12.
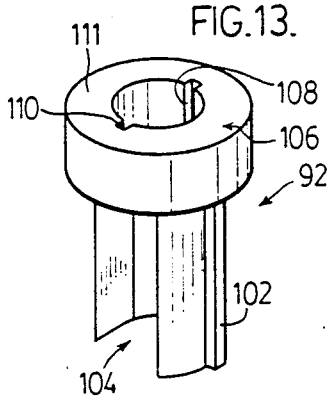
FIG.13.
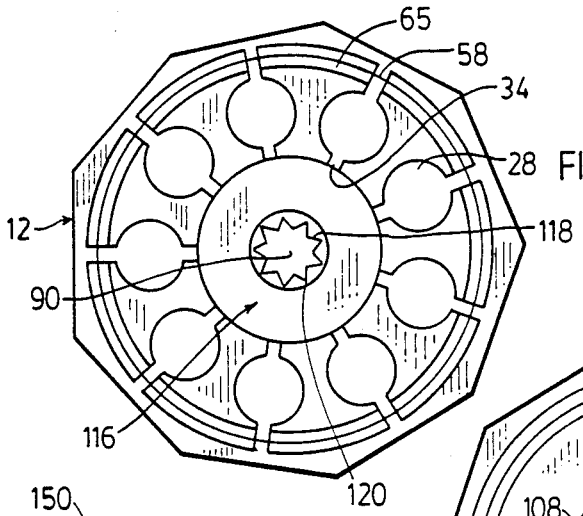
FIG.14.
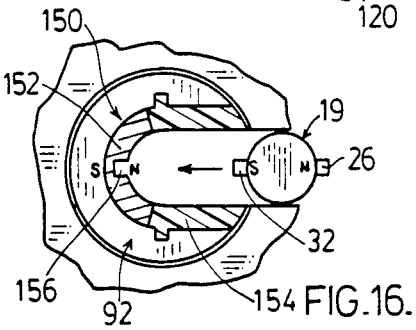
FIG.16.
FIG.15.
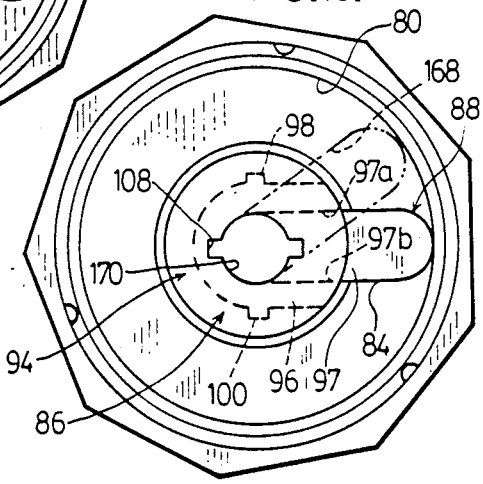

MULTIBIT HAND TOOL WITH IMPROVED CHUCK ARRANGEMENT

This is a Continuation-in-Part Application of Continuation application Ser. No. 06/796,633, filed Nov. 8, 1985 now abandoned, which is a continuation of Ser. No. 681,886, filed Dec. 14, 1984 now U.S. Pat. No. 4,552,043, issued Nov. 12, 1985.

FIELD OF THE INVENTION

This invention relates to hand-held implements having interchangeable objects which are captured within the implement and selected object extendible from the implement for use.

BACKGROUND OF THE INVENTION

There are presently available in the marketplace many forms of multi-object devices. An example is the multibit screwdriver where several bits are contained within the hollow handle. When it is desired to use a particular bit, the handle is opened by unscrewing the cap for the handle and selecting the needed bit. The selected bit is then placed in the chuck at the other end of the handle for use. This system results in the loss of bits, because the bits are not retained within the screwdriver handle.

To overcome this problem, a multibit screwdriver was designed which captures the bit within the handle as particularly disclosed in U.S. Pat. No. 4,463,788 which is owned by the assignee of this application. That multibit screwdriver provides several advantages over other forms of screwdrivers which have attempted to provide arrangements which capture bits within a handle magazine. However, with the construction of the multibit screwdriver of U.S. Pat. No. 4,463,788, difficulty can be encountered in inserting the bit end into the chuck of the screwdriver handle.

The improvement, according to this invention, provides an implement chuck arrangement which facilitates selected object placement in the chuck of the handle.

SUMMARY OF THE INVENTION

According to an aspect of the invention, a multi-object hand-held implement has a handle with a central longitudinal axis and an object selector cup rotatably mounted at the end of the handle to rotate about the central axis. A plurality of elongate objects are provided peripherally of the handle in a circular pattern about the handle axis. Each object provided in the handle to extend essentially parallel to the handle axis. A chuck is provided at the end of the handle. The chuck is aligned with the handle axis for receiving an object end and securing it against rotation.

The cup has a continuous side wall with an interior surface spaced radially outwardly of the radial location of the circular pattern of objects and closed cup end. An elongate slot extends from a central portion of the cup and radially outwardly to the location of an object in the handle. The cup is rotatable to position the slot in register with any desired object in the handle. The slot in the cup is of sufficient width and length to permit outward withdrawal of an object shaft from the handle in a direction generally parallel with the handle axis. Means is provided for retaining a selected object end in the cup.

The object end is movable along the slot towards the cup center into alignment with the chuck for insertion of the object end into the chuck. The chuck has a bore formed within the handle. The bore presents a plurality of internal operative faces for engaging corresponding external operative faces provided on the object end. The number of the operative faces is equal to or a multiple of the number of objects provided in the handle to facilitate thereby the insertion of a selected object end into the chuck bore.

BRIEF DESCRIPTION OF THE DRAWINGS

Various preferred embodiments of the invention are shown in the drawings wherein:

FIG. 9 is a section through the upper portion of the handle showing the detent holder for the bit end;

FIG. 10 is a partial section of FIG. 4 showing the lateral displacement of the selected bit towards the centre of the selector cup;

FIG. 11 is the same section as FIG. 10 showing positioning of the hand tool bit end into the handle chuck;

FIG. 12 is a side plane view of the lower portion of the handle of the multibit hand tool of FIG. 1;

FIG. 13 is a perspective view of the collar insert for insertion in the support of the cup shown in FIG. 5;

FIG. 14 is a section along the lines 14—14 of FIG. 12;

FIG. 15 is a top view of the selector cup of FIG. 5; and

FIG. 16 shows an alternative embodiment of aligning the bit end in the collar for subsequent placement in the handle chuck.

DETAILED DESCRIPTION OF THE PREFERRED EMBODIMENTS

Figure 1:
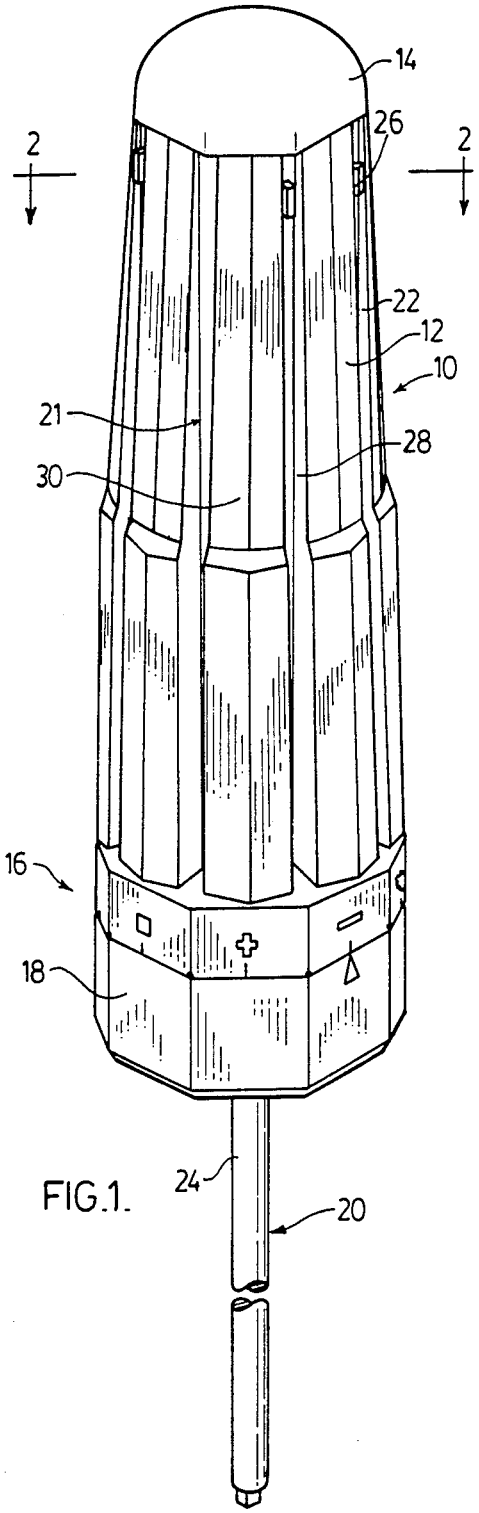
FIG. 1 is a perspective view of the multibit hand tool according to an embodiment of this invention.

It is appreciated that the invention may be incorporated or used in a variety of hand held implements. For purposes of explaining the invention, reference will be made to an embodiment in the form of a multibit screwdriver 10 which is shown in FIG. 1. The screwdriver has a handle portion 12 with cap 14 secured thereto. Mounted to the base portion 16 is a bit selector cup 18. A bit 20 has been selected and locked into the chuck (not shown) of the screwdriver 10. The handle portion 12 of the screwdriver includes a magazine 21 of channels for a plurality of bits carried within the handle. The outer portion 22 of each channel 28 opens outwardly of the handle 12 to expose the screwdriver bit shaft 24 and one of its lugs 26 to be discussed in more detail with respect to the remaining Figures.

Figure 2:
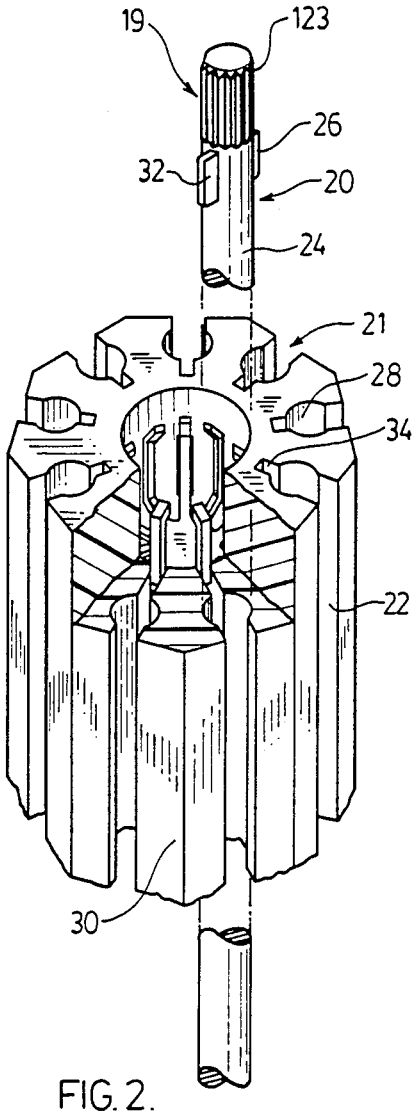
FIG. 2 is a section along the lines 2—2 of FIG. 1.

According to this particular embodiment, the screwdriver handle magazine 21, as shown in FIG. 2, consists of channels 28 all having their outer portions 22 opening to the periphery 30 of the handle. The handle is adapted to carry nine different styles of bits which may be various sizes of the Phillips, Robertson and standard flat form of bits. It is appreciated that the hand tool may be used as an implement to carry a variety of different types of elongate objects which would be selectively presented. For example, instead of the elongate objects being tool bits, the elongate objects may be a variety of ink ball point pens, different coloured pencils, different coloured cosmetic make-up pencils or lipsticks, various small utensils such as kitchen items and the like. It is also appreciated that tool bits may, in addition to screwdriver bits, include files, knives, awls, chisels, etc. It is appreciated that each object would be elongate and resemble in shape the important aspects of the bits shown in the drawings which provide the advantages and features of the invention.

Each bit shaft 24 has a pair of lugs 26 and 32. Each channel 28 is provided with an internal groove 34 which receives one of the lugs of the bit shaft to position it within the respective channel of the handle bit magazine. By the channels 28 opening to the handle periphery in area 22, the lugs 26, such as shown in FIG. 1, are exposed to permit manual manipulation of the lug to push the bit downwardly of the handle when the bit selector cup 18 is rotated to permit selection of that bit in a manner to be discussed with respect to the remaining Figures. Provided in the upper portion of the handle 12 is a detent system 36 for engaging the lug lying in the channel 34 so as to retain the bit in the upper stored position in the handle magazine with the lug resting on the respective detent arm as demonstrated in FIG. 9.

Figure 3:
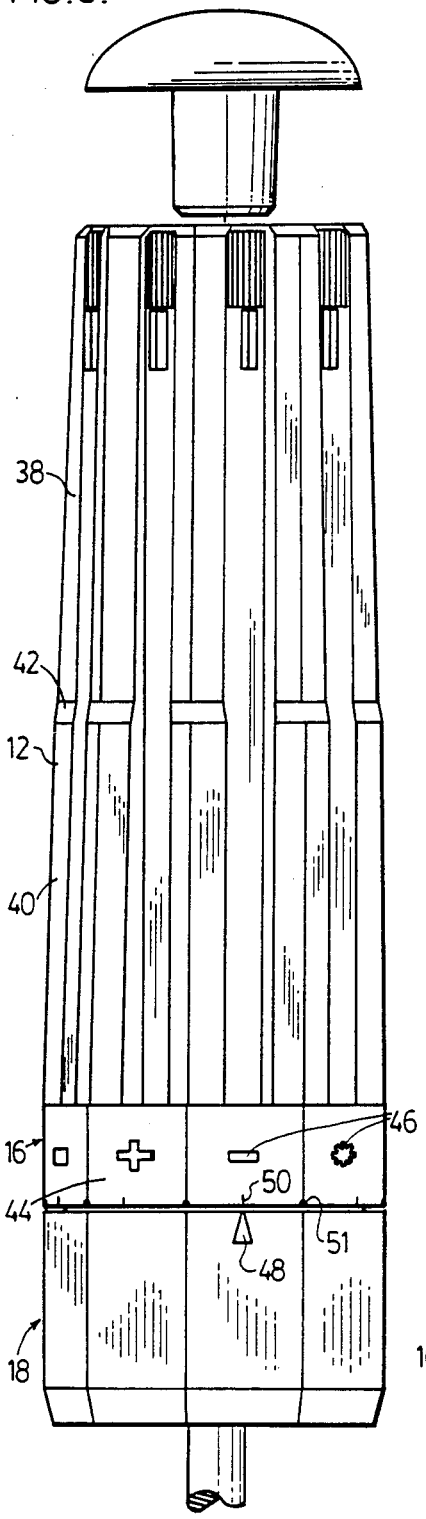
FIG. 3 is a side plan view of the hand tool of FIG. 1.

As shown in FIG. 3, the screwdriver handle 12 has a stepped portion divided into an upper region 38, a lower region 40 and stepped surface 42. This stepped configuration for the handle 12 increases gripping power on the handle during use. The lower portion 16 of the handle includes on its polygonal faces 44 various designs 46 indicating the shape of the bit ends stored in the screwdriver bit magazine of the handle 12. The selector cup 18 may be rotated to register arrow 48 with the line 50 indicating that the particular bit having the configuration associated with the particular dot 50 can be selected for use.

The procedure for selection, as demonstrated in FIGS. 10 and 11, will be discussed after the relationship of the components is explained with respect to FIG. 5.

Figure 5:
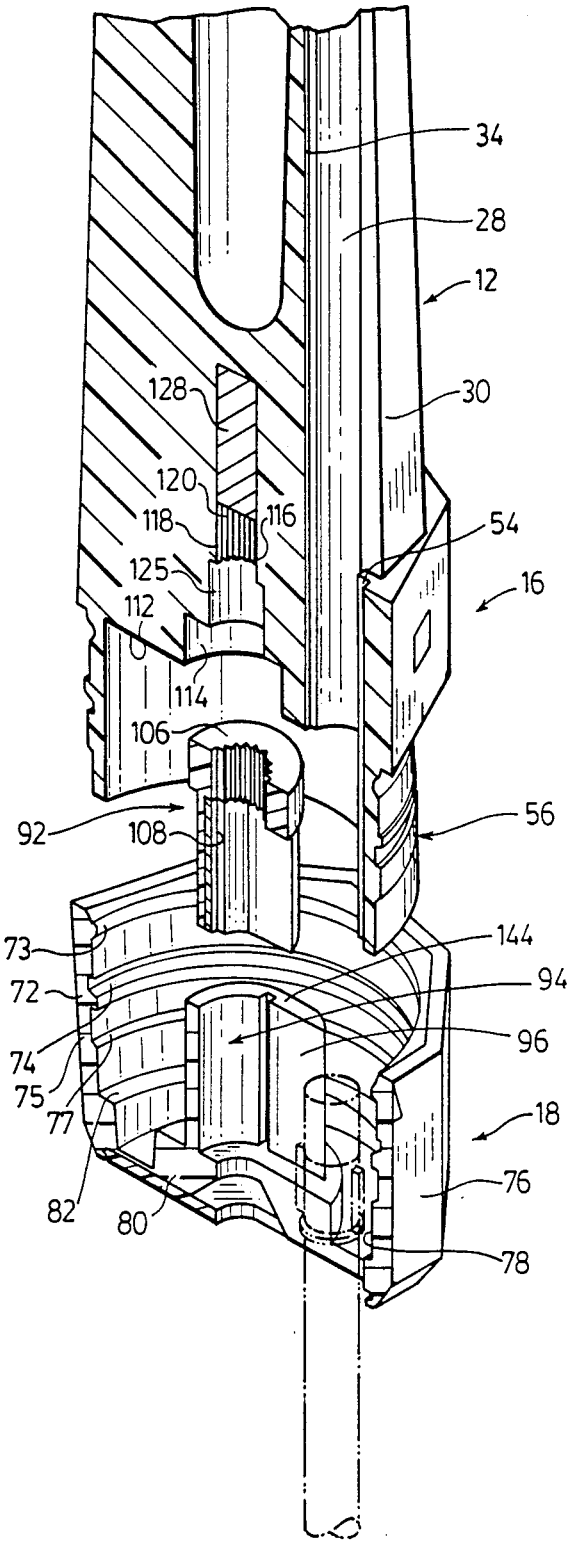
FIG. 5 is an exploded view in section of the multibit hand tool of FIG. 1.

The exploded view of FIG. 5 provides a section through the handle portion 12 and through the selector cup 18. The magazine portion for the several bits in the handle 12 are stored in respective channels 28 which open out to the handle periphery defined by side wall portion 30 of each handle segment. Each channel 28 includes at its rearmost portion a groove 34 which receives a respective lug 26 or 32 of the screwdriver bit end as shown in FIG. 2. At the lower portion 16 of the handle, a groove 54 is provided diametrically opposite groove 34. This groove receives the other lug of the bit end as the bit is extracted from the channel 28. The handle lower portion 16 includes a depending flange 56 which, as shown in more detail in FIG. 12, includes a plurality of slots 58 extending all the way through the flange. Each slot 58 is aligned with a respective groove 54 in the handle lower portion 16. The depending flange 56 has first and second ridges 60 and 61 with lower tapered surfaces 62 and 63 and planar depending surface 64. The ridge 60 includes an upper flange 66 which merges into a recess area defining a groove 68 and tapers outwardly at 70 as the flange merges into the lower portion 16 of the handle. Similarly, the second ridge 61 includes a tapered surface 63 which merges into the lower cylindrical surface 64.

Figure 4:
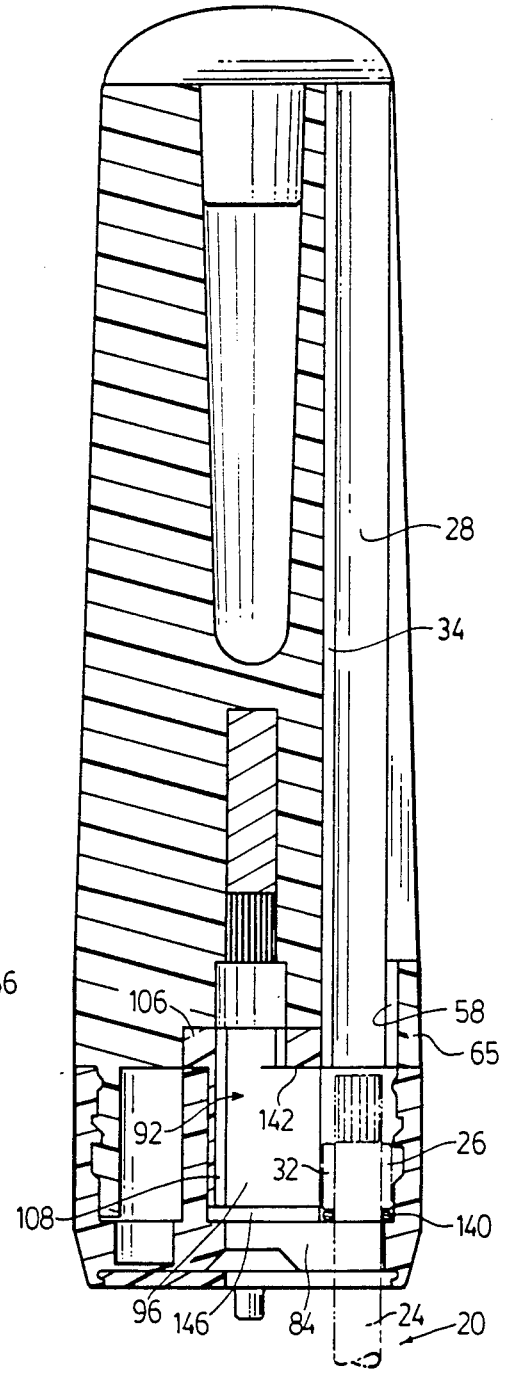
FIG. 4 is a section along the handle axis of the hand tool of FIG. 3.

The selector cup 18 is adapted to snap fit over the depending flange 56 of the handle portion. The selector cup, as shown in FIG. 5, includes mating surfaces 72 and 73 corresponding to the shape of the ridge 60 and groove 68 of the depending flange 56 of the handle. The selector cup has a ridge portion 74 provided with a sloping surface which engages sloping surface 62. Similarly, mating surface 75 for ridge 61 includes sloping surface 77 which is adjacent sloping surface 63 of ridge 61. The sections or fingers 65 of the flange 56 between the slots 58 are flexed inwardly to facilitate snap fitting of the selector cup 18 onto the handle 12 to provide the assembled relationship as shown in FIG. 4, which permits rotation of the selector cup relative to the handle.

The selector cup 18 has a side wall 76 with corresponding interior surface 78. The cup has an end wall 80 with corresponding interior surface 82. As shown in FIG. 15, the cup end wall 80 includes an elongate slot 84 which extends from the central region 86 of the bit selector cup 18 radially outwardly to region 88 which is slightly beyond the radial location of the bits in the bit magazine of the handle 12. The circular pattern for the bits in the bit magazine is demonstrated in the bottom view of the handle of FIG. 14, where each channel 28, according to this embodiment, is arranged in a circular pattern all of equal radial location from the central axis 90 of the handle 12. The slots 58 in the depending flange 56, are diametrically opposed the grooves 34 of each channel and in line with the groove 54 in the lower portion 16 of the handle. Thus when the bit is extracted from a respective channel 22, the bit lug located in the groove 34 aligns the other lug with the slot 58 as the bit end is withdrawn from the channel downwardly into the cavity of the selector cup 18, whereby region 88 of the slot 84 of the selector cup is in line or slightly beyond the outer extremity of each channel 28.

The selector cup 18 is provided with an insert 92 which is supported by a U-shaped wall 94 partially shown in FIG. 5 and completely illustrated from above in FIG. 15. The support 94 has upright wall 96 located about the perimeter of the slot 84 and with an opening 97 extending in the direction of the cup selector slot 84. Each opposing wall of the support 94 has opposing grooves 98 and 100. The insert 92, as also shown in FIG. 13, includes on its extremity lugs 102 which are inserted in the corresponding grooves 98 and 100 of the insert support to locate it in the bit selector cup. The insert 92 is in the shape of a collar with a lateral opening 104 also extending in the direction of the elongate slot 84. At the upper portion of the insert 92 is a ring 106. The ring has opposing grooves 108 and 110 to receive the respective lugs of the bit end. Groove 108 extends the length of the collar as shown in FIG. 5.

By way of providing an insert for the bit selector cup, the insert may be readily injection molded independently of the bit selector cup and its insert supporting device 94. The groove 108 may be formed the length of the insert 92 for purposes to be described with respect to bit selection as shown in FIGS. 10 and 11. With the insert 92 located in the corresponding support 94, the bit selector cup 18 is snap fitted on to the handle 12. The lower end 16 of the handle includes in its bottom area 112 a circular recess 114 which receives the ring 106 of the collar when the bit selector cup is snap fitted over the tongues of the depending flange 56 of the handle.

The chuck 116 in the handle includes a bore 118 with a plurality of operative faces 121 for engaging corresponding operative faces 123 of the bit end, as shown in FIG. 2. Below the chuck bore 118 is an open space 125 which has a diameter greater than the overall distance between the extremities of lugs 26 and 32. Thus regardless of which way the lugs are placed within the space 125, they are not interfered with once the lugs 26 and 32 clear the upper surface 106 of the collar insert 92.

In situations where steel bits are used, it may be desirable to locate a magnet 128 above the chuck 116. The purpose of the magnet is to assist insertion of the bit end into the chuck 116 by attracting the bit upwardly from the collar 92 into the chuck 116. In addition, the use of the magnet 128 above the chuck retains the bit end in the chuck during normal usage of the screwdriver. This avoids the need for locking the bit end in the chuck.

As shown in FIG. 9, the bits 20 are stored in the magazine of channels 28 of the handle 12. The cap 14 is secured to the upper portion 15 of the handle. In the recess 130 of the handle, a detent device 36 is located. An opening is cut through the wall portion 132 of the handle so that the respective arms 134 of the detent cage 36, as shown in FIG. 9, extend through the formed opening 136 into the channel 28. Each finger 134 of the detent has rounded edges 137 to facilitate camming inwardly of the respective detent finger by the lugs when the bit 20 is either inserted or retracted from the magazine. By use of this detent device, the bit 20 is retained in the magazine yet provides for releasable withdrawal of the bit from the magazine with the bit in the stored position when the bit selector cup 18 is rotated to select that particular bit. By way of the channel 22 opening exteriorly of the handle, the lug 26 projects to the extent shown to allow the user to manually engage the lug 26 and push it downwardly depressing the detent finger 134 inwardly as shown by arrow 138 of FIG. 9. Once the lugs of the bit have cleared the detent 36, the bit falls downwardly where the respective lug of the bit end, as located in the groove 34 of the channel, guides its downward descent so that the other lug is aligned with the slot 58 of the depending flange 56 of the handle.

As shown in FIG. 4, the selected bit 20 has been withdrawn from the channel 28 where the groove 34, as it engages lug 32, aligns the other lug 26 with the slot 58 of the depending finger 65. With the lug 26 located in the slot 58, automatic alignment of lug 32 is provided with the groove 108 of the collar 92. A ring 140 is provided about the shaft 24 of each bit. The ring 140 has an external diameter larger than the width of the elongate slot 84 in the bit selector cup, so that by interfering with the lugs 26 and 32, ring 140 precludes withdrawal and thereby retains the selected bit end in the selector cup. In section, the ring 140 is circular in shape to assist in sliding of the ring 140 up and down the bit shaft to avoid jamming of the bit shaft within the ring. Alternatively, the ring 140 may be shaped like an annular cylindrical ring. A groove 141 is provided in the base of the selector cup. This groove receives the bit tips and the shoulders of the groove maintain the ring 140 on the bit shaft in the manner described in more detail in U.S. Pat. No. 4,463,788.

Figure 6:
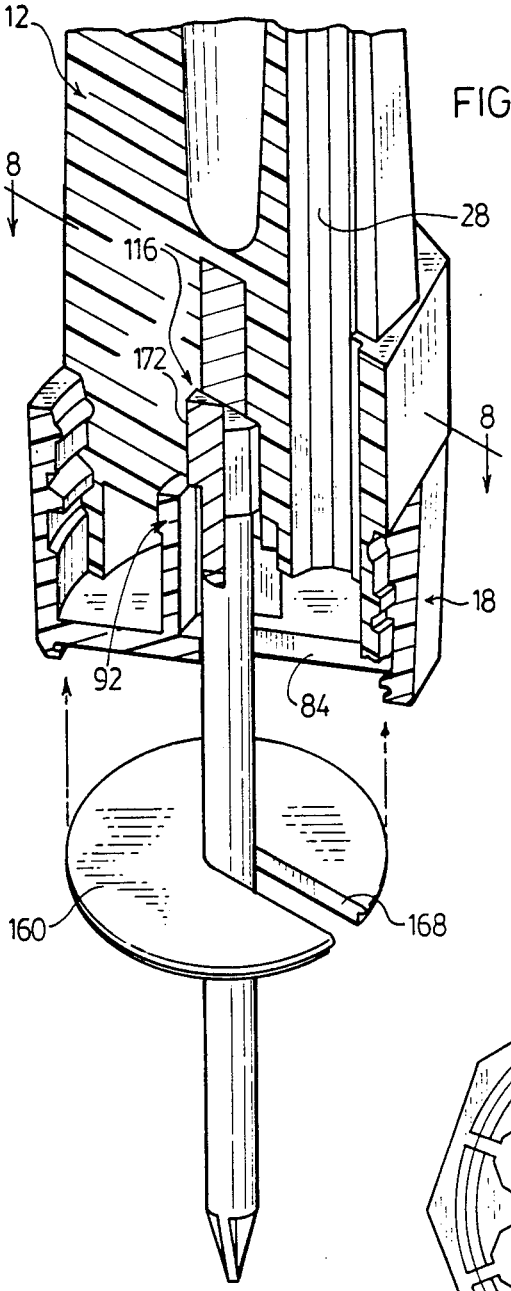
FIG. 6 is a section of the hand tool of FIG. 5 assembled showing an alternate arrangement for the handle chuck.

The collar 92 has a flange portion 142 beneath the collar ring 106. The support wall 96 for the collar includes an upper face 144, as shown in FIG. 5. The length of the collar wall 92 is less than the height of wall 96. With faces 142 of the collar and 144 of the support 96 abutting, a space 146, as shown in FIG. 4, is defined between the insert and the interior wall 82 of the bit selector cup. This space receives the ring 140 as the bit end is moved laterally, radially inwardly of the bit selector cup to within the collar 92 through the lateral opening 104 of the collar insert. The new position for the bit shaft 24 is shown in FIG. 6 with the ring 140 located in the space 146. By way of the slot 58 in the depending flange of the handle, alignment of lug 32 with the groove 108 is provided during the lateral movement in the direction of arrow 148 of the bit.

Turning to FIG. 14, the chuck 116 has a bore portion 118 which is sized to provide operative faces 120 which engage the operative faces 123 of the bit end 19. According to this particular embodiment, the operative face arrangement 123 for the bit end consists of a star-shaped arrangement, the section of which is shown in the chuck bore 118 of FIG. 14. In order to facilitate alignment of the bit end 19 for insertion in the chuck, it has been found that by providing a plurality of operative faces on the bit end equal to or a multiple of the number of bits in the magazine of the handle, the bit without rotation from its aligned position as withdrawn from the respective chamber 28 can be, when moved laterally, inserted directly upwardly into the chuck bore 118. With the star-shaped arrangement, as shown in section in FIG. 14, the chuck bore 118 has nine operative internal face portions 120 in the form of pointed recesses. The lugs 26 and 32 thereby align the corresponding points on the bit end for direct vertical insertion into the chuck 116. To ensure this alignment, the number of operative faces on the bit end will always be equal to or a multiple of the number of channels in the handle bit magazine. Should, for some reason, the bit end be turned around when moving the bit end laterally in the direction of arrow 148 in the manner demonstrated in FIG. 10, the opening 97 is of a width between opening edges **97*a* and 97*b*, as shown in FIG. 15, less than the overall diametrical width of the lug extremities. In the event that the bit is turned slightly after moving the bit end laterally, the lugs will interfere with the opening edges 97*a* and/or 97*b* to encourage the user to turn the bit end so as to commence alignment of one of the lugs with the groove 108** in the collar portion.

According to the embodiment of FIG. 16, the collar 92 is provided at its rear face 150 with a magnet 152 which is integrally molded with the wall portion 154 of the collar 92. At the rear portion 150, the magnet 152 is provided with a groove 156 which functions in the same manner as groove 108 in the collar of FIG. 13. The poles of the magnet 152 are as indicated. In using a bit end 19 formed of steel, the bit end can also be magnetized with the polarity shown. By natural attraction of the north pole of magnet 152 to the south pole of the magnetic bit end 19, lug 32 is naturally aligned with groove 156 of the collar 92. In this manner, another form of aligning the lug of the bit end with the collar groove is provided.

As shown in FIG. 11, with the bit end set up in the collar 92 in the manner discussed with respect to either FIGS. 15 or 16 and due to the arrangement of the operative faces on the bit end and the chuck bore, the bit end 19 is perfectly aligned with the chuck bore 118 so that the bit can be inserted into the chuck in the direction of arrow 158. The magnet 128 attracts the steel bit end 19 into the chuck portion 116. For normal usage of the screwdriver, the magnet 128 is all that is required to retain the bit in the chuck. However, when the selected bit is used as an awl or other like device for penetrating surfaces, it is necessary to lock the bit in the screwdriver handle to prevent withdrawal of the bit as the awl is removed from the surface. In order to lock the bit in place, the bit selector cup 18 may be rotated something less than 180° to thereby misalign the grooves 108 and 110 with the lugs 26 and 32 of the bit end, so that the lugs are captured in the space 125 by the upper surface 111 of the collar ring 106. Preferably the arrow 48 may be aligned with the nearest dot 51 to accomplish locking. To withdraw the bit from the chuck if the selector cup has been rotated to lock the bit in place, the selector cup is rotated back to align the arrow 48 of the selector cup with the marking 46 indicating the particular bit extracted. This will realign the slots 108, 110 with the lugs and permit withdrawal of the bit so that it may be transferred laterally and returned to within the chamber of the bit magazine for storage in the manner shown in FIG. 9.

In some circumstances, it is necessary to stabilize the bit during use, particularly when lateral forces are exerted on the bit. If the lateral force tends to push the bit sideways in the direction of the slot 84, the bit could be bent. A rotatable disc 160, as shown in FIG. 10, is mounted in the bit selector cup 18. The disc at its periphery includes a circumferential ridge 162 which is received in a groove 164 of the bit selector cup. The disc 160 is provided with a handle portion 166 to facilitate for manual rotation of the disc 160 relative to the bit selector cup slot 84. As shown in FIG. 15, rotation of the slot portion 168 of the disc commences closing off of the slot 84 in the cup. When the disc is rotated a complete 180°, the end 170 of the slot 168 captures one side of the bit while the inner portion of slot 84 captures the other side of the bit to grasp this lower portion of the bit shaft 24 to stabilize it and resist lateral forces.

Figure 7:
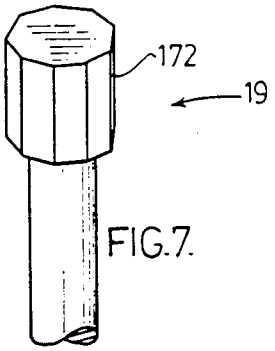
FIG. 7 is a perspective view of a bit end having a nonagonal shape for placement in the corresponding chuck of FIG. 6.
Figure 8:
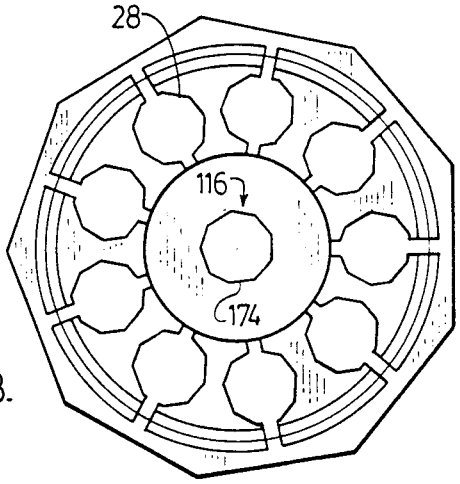
FIG. 8 is a section along the lines 8—8 of FIG. 6.

An alternative chuck arrangement is shown in FIGS. 6, 7 and 8 which eliminates the need of ring 140 to retain the selected bit in the selector cup. An enlarged nonagonal-shaped head 172 is provided at the bit end 19. The lugs 26 and 32 of the bit shown in FIG. 2 are removed. The enlarged head 172 has a width approximating that of the width defined by the extremity of the lugs 26 and 32 of the bit of FIG. 2. The chuck 116 has a bore which is of a size sufficient to receive the enlarged head 172. The bore of the chuck 116 approximates the size of the space 125 of FIG. 5. The enlarged head 172 is of a width greater than the width of the groove 84 of the bit selector cup. Thus when the bit is withdrawn from the chamber 28, the enlarged head interferes with the side walls of the slot 84 to prevent withdrawal of the bit end from the selector cup. The collar 92 has a modified interior surface to receive the nonagonal shape of the enlarged head 172. The upper portion of the collar 92 is enlarged to permit upward insertion of the enlarged head 172 into the chuck 116.

By eliminating the need for the lugs 26 and 32 on the bit and the ring 140 for retaining the bit in the bit selector cup, the overall length of the screwdriver may be reduced due to the elimination of the space 125 of the handle configuration of FIG. 5 and a much thinner bottom wall for the bit selector cup where space 141 of the bit selector cup of FIG. 4 is no longer required.

The shape of the nonagon is shown in more detail in FIG. 8 where the chuck bore 174 has the nine equal sided faces to receive the corresponding faces 172 of the bit end 19. For reasons explained in assuring alignment of the bit end withdrawn from the bit chamber, the number of sides is equal to the number of chambers 28 in the screwdriver handle. It is appreciated that ready alignment of the bit end with the chuck can be achieved with a multiple of the number of chambers in the handle. For example, instead of nine operative faces, eighteen faces could be provided in the chuck bore 174 and on the bit end 19.

It is also appreciated that a variety of shapes for the operative faces on the bit and within the chuck bore can be used to accomplish this feature of the invention in facilitating alignment and insertion of the bit end into the chuck of the screwdriver handle. Thus in accordance with the invention, by providing a number of operative faces on the bit end and chuck bore equal to or a multiple of a number of chambers in the bit magazine, no movement is necessary in bit rotation to insert the bit end into the chuck as long as the alignment of the bit end is maintained in transferring it from the chamber to within the collar. This, of course, is aided by the use of, for example, the lugs 26 and 32 of the bit of FIG. 2, where one of the lugs is received in the groove of the collar to realign the bit end with the chuck should misalignment occur during transfer of the bit from the side of the bit selector cup to centrally of the cup for insertion in the handle chuck.

The use of a depending flange portion 56 on the lower end of the handle, which is slotted, enables one to reduce the overall diameter of the handle by permitting withdrawal of the bit end from the channel through passage of the respective lug of the bit end the slot in the depending flange. By reducing the handle diameter, comfort in use of the screwdriver is provided. Another modification, which can be made to the handle, is to provide about the lower handle periphery 30, a circumferential depression to accommodate the thumb during use.

Due to the slot in the depending flange, alignment of the other lug of the bit end is provided with the groove in the collar. This facilitates use of the tool during selection and insertion of the bit end in the chuck. By way of using an insert for the selector cup, the groove may be provided the length of the insert without any difficulty in molding and manufacturing the part. By providing an insert, the selection cup interior may be readily injection molded and then the insert simply placed into the cup. Such slots in the handle depending flange also facilitate snap fitting of the bit selector cup onto the handle to thereby accommodate tolerances in manufacturing of the cup perimeter and the handle perimeter.

Although preferred embodiments of the invention have been described herein in detail, it will be understood by those skilled in the art that variations may be made thereto in using the invention in a variety of hand held implements such as other types of hand tool bits, or in carrying and presenting ink pens, pencils, cosmetic devices and the like.

We claim:

1. A hand held multi-object implement having a handle with a central longitudinal axis, an object selector cup rotatably mounted at an end of said handle to rotate about said central axis, a plurality of elongate objects provided peripherally of said handle in a circular pattern about said handle axis, each object being provided in said handle to extend essentially parallel to said handle's axis, a chuck provided at said end of said handle, said chuck being aligned with said handle axis for receiving an object end and securing it against rotation, said cup having a continuous side wall with an interior surface spaced radially outwardly of the radial location of said circular pattern of objects and a closed cup end, an elongate slot extending from a central portion of said cup and radially outwardly to the location of said objects in said handle, said cup being rotatable to position said slot in register with any desired object in said handle, said slot in said cup being of sufficient width and length to permit outward withdrawal of an object shaft from said handle in a direction generally parallel with said handle axis, means for retaining a selected object end in said cup, said object end being movable along said slot towards said cup center into alignment with said chuck for insertion of said object end into said chuck, said chuck having a bore formed within said handle, said bore presenting a plurality of internal operative faces for engaging corresponding external operative faces provided on said object end, the number of said operative faces being equal to or a multiple of the number of objects provided in said handle to facilitate thereby the insertion of a selected object end into said chuck bore.

2. A multi-object implement according to claim 1, wherein said object is selected from the group of objects consisting of a tool bit, a pen, a cosmetic make-up stick, and kitchen utensil.

3. A multi-object implement according to claim 1, wherein said object is a tool bit and said implement is a hand tool.

4. A multibit hand tool according to claim 3, wherein said cup has means for supporting a collar above said elongate slot, said collar having a lateral opening in the direction of said elongate slot and said collar being positioned symmetrically of said handle axis, said bit end having means for cooperating with said collar to retain said bit end operative faces within said chuck bore, said bit end cooperating means being provided beneath said bit end operative faces.

5. A multibit hand tool according to claim 4, wherein said handle includes means for releasably holding said bits in said channels.

6. A multibit hand tool according to claim 4, wherein said handle holds nine bits, said bit end of each bit having in cross-section a polygonal shape of nine equal operative external faces, said chuck bore having in cross-section a polygonal shape of nine equal operative internal faces.

7. A multibit hand tool according to claim 4, wherein said bit end cooperating means comprises a pair of diametrically aligned lugs projecting laterally from said bit end, said collar having diametrically opposing slots formed therein to receive said bit end lugs for insertion of said bit end into said chuck, said collar having an upper surface spaced sufficiently below said chuck bore to engage lower edges of said lugs when said collar and cup are rotated after said bit end is inserted in said chuck bore.

8. A multibit hand tool according to claim 7, wherein said collar lateral opening is of a width less than the diametrical overall width of said bit end lugs, thereby requiring said bit end lugs to extend generally in the direction of said cup slot when placing said bit end within said collar.

9. A multibit hand tool according to claim 8, wherein said handle includes a magnet positioned above said chuck, said bit ends being formed of steel, said magnet retaining said bit end in said chuck during use.

10. An implement according to claim 1, wherein said handle, cup and insert is injection molded from a suitable plastic material.

* * * * *